United States Patent [19]

Lautenschläger

[11] Patent Number: 4,778,230

[45] Date of Patent: Oct. 18, 1988

[54] SPACER FOR DRAWER GUIDES

[75] Inventor: Horst Lautenschläger, Reinheim, Fed. Rep. of Germany

[73] Assignee: Karl Lautenschlager GmbH & Co. KG, Reinheim, Fed. Rep. of Germany

[21] Appl. No.: 127,380

[22] Filed: Dec. 2, 1987

[30] Foreign Application Priority Data

Dec. 3, 1986 [DE] Fed. Rep. of Germany ..... 3641325

[51] Int. Cl.[4] ..... A47B 88/00

[52] U.S. Cl. ..... 312/341 R; 312/330 R; 312/348

[58] Field of Search ..... 312/330, 341, 348; 384/18–21; 24/545, 546, 547

[56] References Cited

U.S. PATENT DOCUMENTS

| | | | |
|---|---|---|---|
| 1,286,116 | 11/1918 | Rousset | 312/348 X |
| 2,606,091 | 8/1952 | Buchy et al. | 312/348 X |
| 3,074,766 | 1/1963 | Meyer | 312/348 X |
| 3,172,181 | 3/1965 | Fawick | 24/546 |
| 3,393,808 | 7/1968 | Chirchill | 312/348 X |
| 3,716,650 | 2/1973 | de Mecquenem | 24/546 |
| 3,909,078 | 9/1975 | Riley | 312/348 X |
| 4,523,590 | 6/1985 | Roth et al. | 24/545 X |
| 4,557,531 | 12/1985 | Rock et al. | 312/341 R |
| 4,566,157 | 1/1986 | Packendorff | 24/545 X |
| 4,617,775 | 10/1986 | Padrun | 24/545 X |

*Primary Examiner*—Joseph Falk

[57] ABSTRACT

A spacer for fastening a drawer guide that is too long in itself for a particular drawer to the drawer in question. The spacer is held releasably on the section of the runner rail that extends past the back of the drawer into the interior of the carcase and is in turn releasably joined to the drawer.

9 Claims, 2 Drawing Sheets

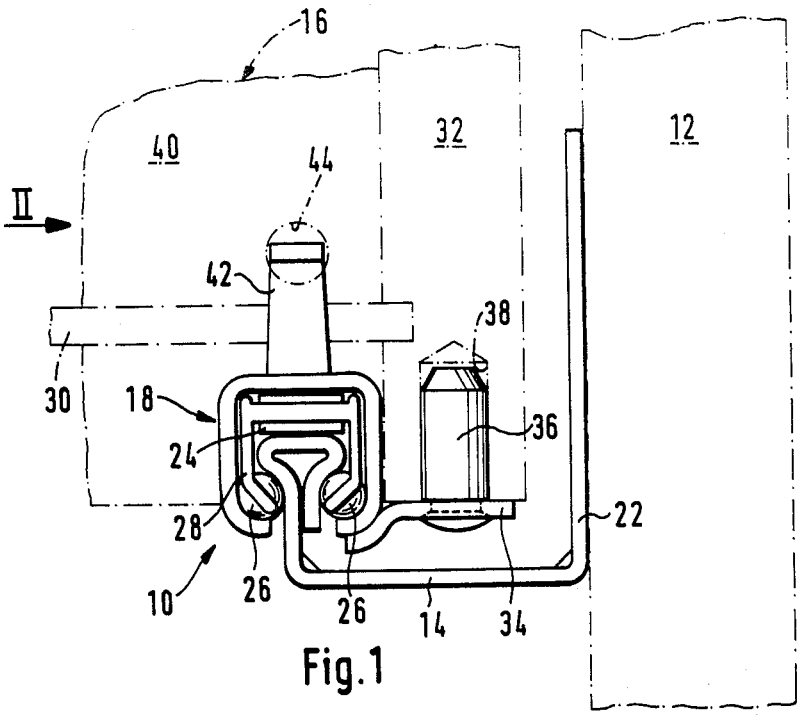
Fig.1
Fig.2
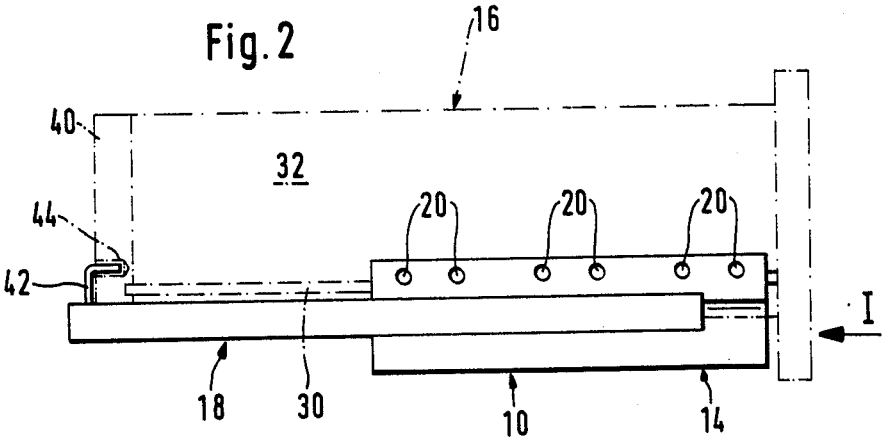

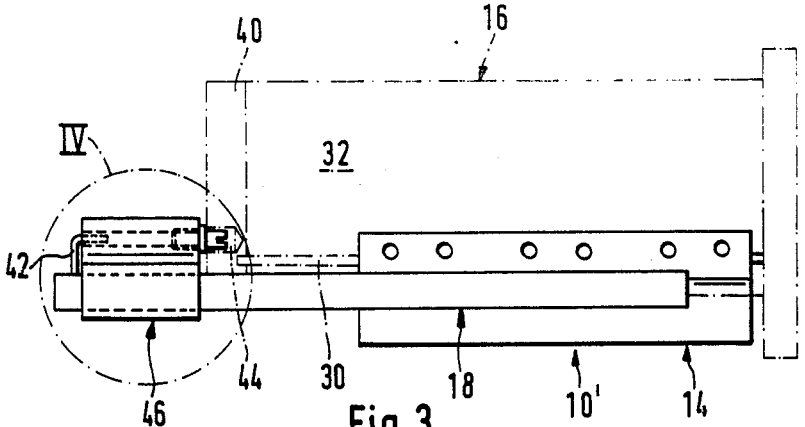
Fig.3
Fig.4
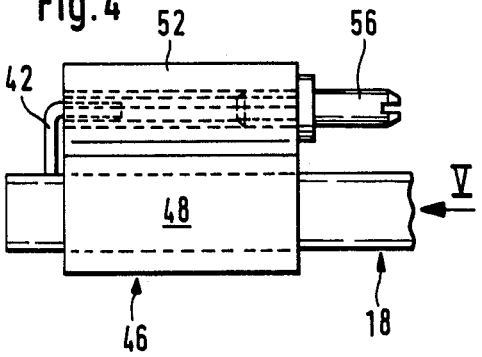
Fig.5
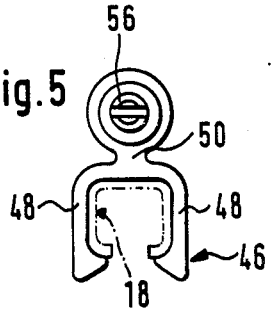
Fig.7
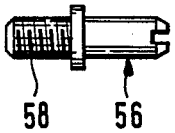
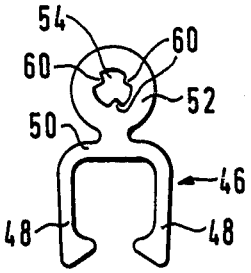
Fig.6

SPACER FOR DRAWER GUIDES

The invention relates to a spacer for drawer guides in which the guide rail that is to be fastened to the carcase wall is engaged from underneath in the corresponding runner rail which is formed by an open-bottomed hollow tubular member which is to be removably fastened to the drawer and forms in its interior races for rolling bearings held in an elongated cage. The rolling bearings can roll on the races of the guide rail on the one hand and on the other hand they can roll on races formed by associated portions of the inside surface of the runner rail, and thus permit the runner rail to run longitudinally relative to the guide rail. The rearward end of the runner rail is fastened to the drawer by means of a hook which projects from the runner rail behind the back of the drawer and can be inserted into a substantially horizontal bore in the drawer back.

On account of the great number of rolling bearings in the form of balls and/or rollers spaced apart not only in the direction of drawer movement but also at right angles thereto, drawer guides of this kind have the advantage, in addition to their easy running and great load-bearing capacity, that they also have a high transverse stability even in the fully open state, so that a drawer mounted on them in a cabinet has no marked free play in the horizontal transverse direction, even in the fully open state. For the mounting of drawers in high-quality furniture, therefore, drawer guides of this kind are being used to an increasingly great extent. In comparison to roller guides which are also used to a great extent but are more critical as regards their transverse stability in the open state, the drawer guides concerned herein are more complicated and are accordingly expensive to manufacture. To be able to offer them at all on a price-competitive basis, they have to be manufactured in large series. This means, however, that only certain frequently used lengths of these drawer guides are available, while for drawers of a length differing from the standard dimensions drawer guides of the kind herein concerned are not being offered. The plastic cage which holds the rolling bodies between the guide rail and runner rail and keeps them properly spaced apart brings it about that the travel of the drawer guides here in question is limited to a distance that is shorter than the length of the corresponding drawer, so that the back of the fully open drawer is still inside of the carcase by a distance corresponding to the length of the cage, i.e., drawer guides of the kind here in question are so-called "partly-opening" guides. Especially in the case of shallow drawers of very great length, the portion that is still inside of the carcase with the drawer fully open is hard to see and reach. It is therefore desired to manufacture these guides as "fully-opening" whereby the drawer can be drawn far enough out of the carcase that its back will be more or less flush with the front of the carcase. Full opening is achieved in drawer guides of a different kind, for example the roller guides mentioned above, by a combination of two single roller guides into so-called "double drawer guides." In the drawer guides in question, this means of creating a fully-opening guide is not feasible for reasons of cost. On the other hand, however, in a number of cases, particularly in the case of very deep cabinets, such as kitchen counter cabinets, drawers of shorter length than the depth of the carcase are made, in which case often no drawer guide of the kind in question can be supplied in the appropriate length, while a longer guide that does fit in the corresponding cabinet carcase is available.

The invention is addressed to the problem of creating a possibility for the use of drawer guides of the kind here in question in a given length for the installation in a cabinet carcase of drawers having a shorter length than the depth of the cabinet, for which the drawer guide that is available is itself too long, so that the drawer cannot be fastened on the runner rail in the area of the drawer back.

This problem is solved according to the invention by a spacer of resilient material which is in the form of a channel open at the bottom to accommodate the guide rail, which can be clipped onto the rearward end area of the outer surface of the runner rail, and from whose upper side a projecting ridge extends substantially beyond the height of the spacer and has at least in its rearward end area and in its forward end area a bore or pocket opening at the level of the horizontal bore in the back of a corresponding drawer into which on the one hand the hook of the runner rail can be inserted, while in the front bore or pocket a pin projecting toward the back of the drawer is inserted. The excessively short drawer can now be combined with the longer drawer guide, while the rearward part of the drawer can be fastened to it by the spacer according to the invention. The mounting hook provided on the runner rail engages in the bore or pocket in the rearward end of the ridge, while the actual mounting of the drawer is performed by the pin engaging in the drawer-back bore. The possibility of using a drawer guide that in itself is too long for the drawer in question now has the additional advantageous effect that the prolonged drawer guide makes available a longer opening run thereby enabling the drawer guide, which of itself could be considered functionally as "partially opening" acts like a "fully opening" guide in connection with the shorter drawer.

The bore or pocket in the ridge extends preferably through the entire length of the ridge.

In a preferred embodiment of the invention, the spacer is a section of an elongated molding cut to the necessary length. Thus it is possible without keeping a supply of spacers of different length to use any desired drawer with a drawer guide that in itself is too long, of the kind here in question, by making the spacer individually by cutting a portion of the necessary length from the molding.

The moldings are preferably made from a resilient plastic, and it has proven desirable to produce them by extrusion.

Alternatively, the molding forming the spacer can also be formed from a strip of originally flat sheet metal, but this represents greater complexity of manufacture and thus greater cost in comparison to production from plastic.

That portion of the pin which is inserted into the front end of the bore or pocket in the ridge to join the runner rail to the drawer can, in an advantageous further development of the invention, be provided with a screw thread and can be screwed into the bore or pocket.

If the spacer is made from plastic in the manner mentioned above, a configuration is desirable in which the bore or pocket has an inside diameter corresponding essentially to the outside diameter of the threaded section of the bore, while longitudinally disposed ribs or ridges project radially inwardly from the inner surface of the bore or pocket, in which the threads of the pin form a female thread when driven in for the first time.

The ribs or cleats are then best made with a triangular cross section with the apex of the triangle pointing toward the longitudinal central axis of the bore or pocket.

The invention is further explained in the following description of an embodiment in conjunction with the drawing, wherein:

FIG. 1 is a front end view of a drawer guide of the kind herein concerned, as seen in the direction of the arrow I in FIG. 2, FIG. 2 is a side view of the drawer guide according to FIG. 1, on a reduced scale, as seen in the direction of arrow 2 in FIG. 1, FIG. 3 is a side view similar to FIG. 2 of the drawer guide which is provided at its rearward end with a spacer according to the invention for the mounting of a drawer which is comparatively too short in length, FIG. 4 is an enlarged detail of the section within the circle 4 drawn in broken lines of the runner rail with the spacer placed thereon, FIG. 5 is a view seen in the direction of arrow 5 in FIG. 4, FIG. 6 is a view of the spacer seen in the same direction as in FIG. 5, but without the pin serving for fastening the drawer, and FIG. 7 is a side view of the pin omitted from FIG. 6.

A drawer guide of the kind here in question (known), designated by the number 10, is shown in in FIGS. 1 and 2, representing a guide rail 14 to be attached to a carcase side wall, indicated in broken lines in FIG. 1, and a runner rail 18 which can be fastened to a drawer 16, also indicated in broken lines in FIG. 1, and which is disposed for longitudinal displacement on the guide rail. The guide rail 14 is in this case a channel of U-shaped cross section formed from sheet metal, of which one limb of the U forms a plate 22 which is provided with bores 20 for mounting screws and can be screwed onto the inside of the wall 12, while the second limb of the U is shaped at its free end such that within the runner rail 18 to be further described below it has races disposed parallel and at a distance from the mounting plate 22, for rolling bearings in the form of cylindrical rollers 24 rolling on an upper, planar track and two rows of balls 26 rolling in two hollowed races spaced horizontally apart. The rollers 24 and the balls 26 are held in their mutual relationship and alignment by an appropriately shaped cage 28 of plastic.

The runner rail 18 is in turn in the form of a tubular rail which is provided at its bottom with an open slot to accommodate the limb of guide rail 14 that is provided with the bearing races, and which is so shaped in cross section as to fit closely around the rollers 24 and the balls 26, so that the inside surfaces of the runner rail 18 which engage the rolling bearings also serve as races therefor.

The runner rail 18 is fastened to the drawer 16 in the position which can be seen in FIG. 1, under the bottom 30 of the drawer and alongside the inside face of the drawer side 32 which projects downward beyond the bottom 30. The actual fastening is accomplished in the forward area by means of a horizontal lug 34 projecting toward the mounting plate 22 and having a pin 36 projecting vertically upwardly which is forced into an associated bore 38 in the bottom edge of the downwardly projecting drawer side 32. At its rearward end within the carcase the runner rail 18 extends a distance past the back 40 of the drawer and there it has a fastening hook 42 which consists of one limb which projects perpendicularly upward from the upper horizontal face of the runner rail 18, and a second, horizontal limb adjoining the free end of the first limb and bent forwardly therefrom, i.e., outwardly from the carcase interior. The horizontal limb of the hook 42 is normally inserted into a bore 44 in the back 40 of the drawer, as indicated in FIG. 2.

To remove the drawer from the runner rail 18 and thus from the drawer slide 10, it is therefore sufficient first to open the drawer fully and then to lift it at its front end sufficiently to release the pin 36 from the bore 38, whereupon the drawer is then pulled further forwardly in the opening direction. Then the horizontal limb of the hook 42 passes out of the bore 44 and the drawer can be freely removed in the forward direction.

As described thus far, the drawer guide is known. It is apparent that the described manner of fastening the drawer to the runner rail requires a precise adaptation of the location of hook 42 with respect to the rear surface of the back 40 of the drawer 16, which contains the bore 44, i.e., the drawer guide 10 must be especially adapted in length to a particular length of drawer.

To obviate this relationship between the drawer and the drawer guide, and, at least in cases in which the length of the drawer is less than the depth of the carcase, to be able to use drawer guides which are not adapted to the precise length of the drawer, the spacer 46 has been developed by the invention which is shown diagrammatically in FIG. 3 and in detail in FIGS. 4 to 7. In FIG. 3 it can be seen that the runner rail extends well past the back 40 of the drawer 16 in the fully closed state as represented, i.e., that the drawer guide 10' in this case does not fit the drawer 16. The hook 42 provided at the back end of the runner rail 18 is located so far in back of the back 40 of the drawer 16 that it cannot be engaged in the bore 44, so that the drawer 16 is not held on the runner rail at its rearward end. In the fully open state the drawer could then drop downwardly, especially when loaded with heavy objects in the area ahead of the front end of the runner rail 18.

This possibility, however, is forestalled by the spacer 46 according to the invention, which in the illustrated case is formed of a clip made of a resilient plastic which can be snapped downwardly over the runner rail, and which has two lateral limbs 48 whose free ends hook slightly around the bottom of the runner rail such that the limbs 48, which in the relaxed state of the clip are tilted slightly toward one another, when placed upon the upper side of the runner rail 18 for the purpose of snapping the clip in place, will spread apart automatically when a downward pressure is exerted on the clip. When the correct position for the installation of the clip on the runner rail 18 has been reached, the limbs 48 of the clip spring partially back toward one another, but then clasp the runner rail and catch beneath the bottom thereof. The length of the clip in the direction of the drawer movement is made to be precisely the same as the excess of the length of the drawer guide 10' with respect to the drawer 16.

A ridge 52 extending over the length of the spacer rises centrally from the upper side of the neck 50 in the profile of the spacer, and in the illustrated embodiment is of a round cross section, and a bore 54 passes through its entire length. This bore 54 is disposed at precisely the level at which the horizontal limb of the hook 42 is situated. This horizontal limb thus engages the bore 54 and prevents any unintended escape of the clip 46 from the runner rail 18.

Into the opposite orifice of the bore 54, i.e., the one facing the front of the drawer, there is inserted a pin 56 (FIG. 7), part of the pin projecting toward the back of the drawer, i.e., into the bore 44 intended to receive the horizontal limb of the hook 42. The section 58 of the pin that lies in the ridge 52 is threaded and can therefore be screwed into the bore 54.

The bore 54 in ridge 52 is of a basically circular cross section corresponding approximately to the outside diameter of the threaded section 58 of pin 56, but three longitudinal ribs 60 of triangular cross section project inwardly radially therefrom at equal intervals. The threaded section 58 of the pin 56, when driven for the first time into the bore 54, will automatically cut its mating thread into the ribs 60.

It can now be seen that the described clip is especially suited for production from plastic by the extrusion method, i.e., the clip can be made in the form of long extrusions from which pieces can be cut to the length required in any particular case. Thus the spacers 46 can be made in any desired length by simply measuring and cutting them from the extrusions. Then the pin 56 must be driven into the bore 54, and this is facilitated by the screwdriver slots provided at the free ends of the pin.

It is apparent that a drawer 60 fastened by means of the spacer 46 to a drawer guide that is too long for it can be held in the same manner as it would be on one of the correct length, and that it can also be removed therefrom in the same manner, the only exception being that the horizontal limb of the hook 42 is replaced by the pin 56 engaged in the bore 44 in the back 40 of the drawer. A drawer guide that in itself is too long for a particular drawer will, however, give a drawer a greater length of travel than will a guide of correct length; as a result, the drawer held on the drawer guide 10 by means of the spacer 46 can be drawn further out of the carcase than can one held on a drawer guide of the "correct" length of the drawer. It is therefore brought about that, without any complication of construction, the drawer can be drawn out further and, in the ultimate case, it can be drawn out until its back 40 is flush with the open front of the carcase the same as a "fully opening" drawer.

I claim:

1. A drawer guide comprising: an elongated guide rail to be fastened to a carcase wall, an elongated runner rail fastened to a drawer and being an open-bottomed hollow molding removably engaged by said guide rail and with said guide rail defining races, an elongated cage with rolling bodies rolling on said races to permit longitudinal displacement of the runner rail relative to the guide rail; said runner rail having a substantially L-shaped hook with a first leg projecting from said runner rail upwardly and a second leg projecting forwardly from said first leg; said drawer having a rear wall extending substantially perpendicularly upwardly from said runner rail and being spaced from said second leg; a bore in said rear wall; and a spacer bridging the space between said first leg of said hook and said rear wall and connecting the latter to said runner rail, said spacer being of resilient material and having an open bottom removably fastened onto said runner rail, having a top ridge with a front end and a rear end, and also having a pin at the front end and received in the bore; and an opening in the rear end and receiving said second leg of said hook.

2. A drawer guide according to claim 1, wherein the opening in the ridge extends over the entire length thereof and said pin is inserted in said opening.

3. A drawer guide according to claim 2, wherein the pin has a section with a thread screwed into the opening.

4. A drawer guide according to claim 3, wherein the opening has a free cross-section corresponding substantially to the outside diameter of the thread on the pin and also has elongated ribs projecting radially inwardly, the thread of the pin forming a counter thread when screwed in for the first time.

5. A drawer guide according to claim 4, wherein the ribs have a cross-section forming a triangle, the apex of the triangle pointing toward the axis of the opening.

6. A drawer guide according to claim 1, wherein said spacer is an elongated molding.

7. A drawer guide according to claim 6, wherein the molding is made from a resilient plastic.

8. A drawer guide according to claim 7, wherein the molding is an extruded molding.

9. A drawer guide according to claim 6, wherein the molding is formed from an originally flat sheet metal.

* * * * *